US006806238B1

(12) United States Patent
Lorentz et al.

(10) Patent No.: US 6,806,238 B1
(45) Date of Patent: Oct. 19, 2004

(54) USE OF LAMELLAR CRYSTALLITES AS EXTREME PRESSURE ADDITIVES IN AQUEOUS LUBRICANTS, LAMELLAR CRYSTALLITES AND METHOD FOR OBTAINING SAME

(75) Inventors: Gilles Lorentz, Courbevoie (FR); Jean-Marie Georgees, Lyons (FR)

(73) Assignee: Rhodia Chimie, Courbevoie Cedex (FR)

( * ) Notice: Subject to any disclaimer, the term of this patent is extended or adjusted under 35 U.S.C. 154(b) by 46 days.

(21) Appl. No.: 10/111,002

(22) PCT Filed: Oct. 23, 2000

(86) PCT No.: PCT/FR00/02944

§ 371 (c)(1),
(2), (4) Date: Jul. 24, 2002

(87) PCT Pub. No.: WO01/29159

PCT Pub. Date: Apr. 26, 2001

(30) Foreign Application Priority Data

Oct. 21, 1999 (FR) ..... 99 13139

(51) Int. Cl.[7] ..... C10M 173/02; C10N 20/06; C10N 40/20

(52) U.S. Cl. ..... 508/150; 508/431; 508/440; 508/459; 72/42; 516/56; 516/75; 516/97

(58) Field of Search ..... 508/431, 150

(56) References Cited

U.S. PATENT DOCUMENTS 3,036,118 A * 5/1962 Jackson et al. ..... 560/182
4,452,711 A 6/1984 Laemmle
5,807,810 A * 9/1998 Blezard et al. ..... 507/103
5,964,692 A * 10/1999 Blezard et al. ..... 516/59
6,166,095 A * 12/2000 Bryan et al. ..... 516/59
6,372,697 B1 * 4/2002 Lorentz et al. ..... 508/198

FOREIGN PATENT DOCUMENTS

| | | |
|---|---|---|
| EP | 0 430 602 | 6/1991 |
| FR | 2 758 561 | 7/1998 |

* cited by examiner

*Primary Examiner*—Ellen M McAvoy
(74) *Attorney, Agent, or Firm*—Burns, Doane, Swecker & Mathis, L.L.P.

(57) ABSTRACT

The invention concerns the use as extreme pressure additive in aqueous lubricants used for deforming or transforming metals, lamellar crystallites having a length (L) ranging between 0.1 and 100 $\mu$m, a width (I) ranging between 0.5 and 30 $\mu$m and a thickness (e) ranging between 5 and 200 nm, comprising a stack of organic phases (O) and of aqueous solutions (A) in the sequence O/[A/O]n, n being an integer different from 0 and such that the stack has a thickness between 5 and 200 nm, the organic phases comprising: i) at least an acid selected among: carboxylic acid, saturated or unsaturated, comprising at least 5 carbon atoms, acid phosphate esters of formula $(RO)_x$—P(=O)$(OH)_{x'}$ wherein R is a hydrocarbon radical, optionally polyalkoxylated, x and x' being equal to 1 or 2, provided that the sum of x and x' is equal to 3, said acid being optionally neutralized by an organic or mineral base; and at least a metal in the form of a multivalent ion; or (ii) at least a polyalkylene block polymer having a cloud point preferably ranging between 30 and 90° C. The invention also concerns said lamellar crystallites and a method for obtaining them.

27 Claims, No Drawings

USE OF LAMELLAR CRYSTALLITES AS EXTREME PRESSURE ADDITIVES IN AQUEOUS LUBRICANTS, LAMELLAR CRYSTALLITES AND METHOD FOR OBTAINING SAME

The present invention relates to the use of lamellar crystallites as extreme pressure additives in aqueous lubricants. It also concerns these lamellar crystallites, and their production.

Lubricants have to be used during operations for transforming and deforming metals, such as rolling, drawing or cutting. During such operations, which are carried out under very severe speed, pressure and applied force conditions, the coefficient of friction between the metal and the tool for carrying out the transformation/deformation is very high. This causes rapid wear of the tool surface. Such rapid wear is the cause of tool breakage and the appearance of superficial defects in the transformed/deformed metal. The use of a lubricant can considerably reduce this coefficient of friction, and thus the problems with wear and surface defects.

A number of different types of lubricant exist, namely oily and aqueous lubricants. The field of application of the first is more limited than the second, as under extreme conditions, oily lubricants are not capable of sufficiently compensating for the heating of the metal. This results in fusion, which welds the metal and tool together, such welding immobilises the assembly. The use of additives known as "extreme pressure" additives can delay the appearance of such phenomena.

However, under extreme conditions, aqueous lubricants are preferably used. One advantage of such lubricants lies in the fact that they can cool the metal surface because of the heat conducting capacity of water. For this reason, the disadvantages encountered with oil-based lubricants regarding heating are partially resolved. In contrast, the requirements for "extreme pressure" additives as regards getting to grips with the coefficient of friction and wear remain acute.

The present invention concerns the use of lamellar crystallites of micronic dimensions in aqueous lubricants as extreme pressure additives, comprising a stack of organic phases and aqueous solutions; said crystallites are dispersed in the aqueous lubricant.

It has ben established that such lamellar crystallites, with a length of 100 $\mu$m or less, a width of 30 $\mu$m or less and with a thickness of 200 nm or less, come into contact with the surface of the metal to be transformed, and they encourage lubrication as the lamellar crystallites slide with respect to each other during the transformation/deformation operation.

Further, heating of the metal surface is not observed because of the aqueous phase in witch the lamellar crystallites are dispersed.

Other advantages and characteristics of the invention will become clear from the following description and example.

It should be noted that the accompanying figure shows a photograph taken using transmission electron microscopy (Cryo-TEM; scale of the photograph: 2 $\mu$m). It shows the lamellar crystallites of the invention.

Thus, in a first aspect, the invention concerns the use, as an extreme pressure additive employed in aqueous lubricants used for deforming or transforming metals, of lamellar crystallites with a length (L) in the range 0.1 $\mu$m to 100 $\mu$m, a width (l) in the range 0.5 $\mu$m to 30 $\mu$m and with a thickness (e) in the range 5 nm to 200 nm, comprising a stack of organic phases (O) and aqueous solutions (A) in the order $O/[A/O]_n$, n being a whole other than 0 and such that the thickness of the stack is 5 nm to 200 nm, the organic phases comprising:

i) at least one acid selected from:
- saturated or unsaturated carboxylic acids containing at least 5 carbon atoms;
- acid phosphate esters with formula $(RO)_x—P(=O)(OH)_{x'}$, in which formula R is a hydrocarbon radical, optionally polyalkoxy, x and x' being equal to 1 or 2, provided that the sum of x and x' is 3;
- said acid optionally being neutralised by an organic or mineral base; and at least one metal in the form of a multivalent ion; or ii) at least one polyoxyalkylene block polymer exhibiting a cloud point.

In a second aspect, the invention is constituted by such lamellar crystallites.

In a still further aspect, the invention is costituted by the production of lamellar crystallites.

In a first variation in producing the lamellar crystallites of the invention, and when the lamellar crystallites comprise organic phases i), the process consists of bringing a solution or a dispersion comprising the acid, which may be neutralised into contact with the metal in the ionic and/or metallic form.

In a second variation in producing the lamellar crystallites of the invention, and when the lamellar crystallites comprise organic phases ii), an aqueous mixture is prepared comprising the polymer, then the temperature of the mixture is increased locally to a point above the cloud point of the block polymer. More particularly, this temperature increase is carried out close to the metal surface to be treated/deformed, in particular by the release of the heat resulting from friction or deformation of the metal.

The lamellar crystallites will be described first for clarity.

As indicated above, the length of said lamellar crystallites is in the range 0.1 $\mu$m to 100 $\mu$m. Preferably, the length of the lamellar crystallites is in the range 0.5 $\mu$m to 20 $\mu$m.

Further, the width of the lamellar crystallites is between 0.5 $\mu$m and 30 $\mu$m. More particularly, the width of the lamellar crystallites is in the range 0.5 $\mu$m to 10 $\mu$m.

Finally, the thickness of the lamellar crystallites is in (he range 5 nm to 200 nm, preferably in the range 10 nm to 100 nm.

The dimensions of the lamellar crystallites indicated above correspond to mean values. In other words, there exists a distribution of lamellar crystallite sizes with the mean located in the ranges given above.

The dimensions of the lamellar crystallites are measured by transmission electron microscopy of a sample that is vitrified cryoscopically (Cryo-TEM—see O. Aguerre-Chariol, M. Deruelle, T. Boukhnikachvili, M. In, N. Shahidzadeh, "Cryo-MET sur échantillons vitrifiés: principes, applications aux émulsions et dispersions de tensioactifs" [Cryo-TEM on vitrified samples principles, applications to surfactant dispersions and emulsions], Proceedings du Congrés Mondial de l'Emulsion, Bordeaux, France (1997)).

More particularly, the lamellar crystallites are constituted by a stack of organic phases (O) and aqueous solutions (A) in the order $O/[A/O]_n$, n being a number other than 0 and such that the thickness of the stack is 5 nm to 200 nm.

More particularly, n is a positive whole number that can be at most 100. Preferably, n is a whole number in the range 1 to 20.

In a first embodiment of the present invention, the lamellar crystallites comprise organic phases constituted by at least one acid and at least one metal in the form of a multivalent ion.

The acid forming part of the composition of said phases is selected from:

saturated or unsaturated carboxylic acids containing at least 5 carbon atoms;

acid phosphate esters with formula $(RO)_x—P(=O)(OH)_{x'}$, in which formula R is a hydrocarbon radical, optionally polyalkoxy, x and x' being equal to 1 or 2, provided that the sum of x and x' is 3;

Further, said acid is optionally neutralised by an organic or mineral base.

It should be noted that the organic phase can comprise either a single type of acid or a mixture of these two types. In each of these types, they can also comprise a single acid or a mixture of a plurality thereof.

More particularly, the carboxylic acids that can be used in the composition of the organic phases of the lamellar crystallites of the invention are selected from saturated or unsaturated mono- or poly-carboxylic acids containing 5 to 40 carbon atoms.

Preferably, they have the following formula:

$$R^1—COOH;$$

in which formula $R^1$ represents a linear or branched alkyl radical or an alkenyl radical containing one or more ethylenically unsaturated bonds, containing 5 to 40 carbon atoms (including the carbon atom of the carboxyl group), optionally substituted with one or more hydroxyl radicals and/or at least one carboxylic function.

In an advantageous implementation of the invention, the acid corresponds to the above formula in which $R^1$ represents an alkyl radical containing 7 to 30 carbon atoms, optionally substituted with one or more hydroxyl radicals and/or one or more, preferably one, carboxyl It should be noted that the second carboxyl function, if present, may or may not be at the end of the chain.

Preferably, organic phase i) derives from at least one fatty acid, more particularly containing a single carboxyl functions.

Examples of saturated fatty acids that can be cited are stearic, palmitic and behenic acid.

Examples of unsaturated fatty acids that can be cited are unsaturated fatty acids with a single double bond such as linderic acid, myristoleic acid, palmitoleic acid, oleic acid, petroselenic acid, doeglic acid, gadoleic acid and erucic acid; unsaturated fatty acids containing two double bonds such as linioleic acid; unsaturated fatty acids containing 3 double bonds such as linolenic acid; unsaturated fatty acids conaining more than 4 double bonds such as isanic acid, steardonic acid, arachidonic acid and chypanodonic acid; unsaturated fatty acids carrying a hydroxyl group such as ricinoleic acid, and mixtures thereof.

Of the above acids, palmitic, behenic; stearic, palmitoleic, oleic, petroselenic, erucic, linoleic, linolenic and ricinoleic acid are preferably used.

The acid phosphate esters have the following formula:

$(RO)_x—P(=O)(OH)_{x'}$, in which R, which may or may not be identical, represents a hydrocarbon radical, optionally polyalkoxylated, x and x' being equal to 1 or 2, provided that the sum of x and x' is 3.

Preferably, the acid phosphate easter has the following formula:

$$[R(OA)_y]_x—P(—O)(OH)_{x'},$$

in which fonmula R, which may or may not be identical, represents a hydrocarbon radical containing 1 to 30 carbon atoms, A is a linear or branched alkylene radical containing 2 to 4 carbon atoms, y, which is a mean value, is in the range 0 to 100, x and x' being equal to 1 or 2, provided that the sum of x and x' is 3.

More particularly, R is a saturated or unsaturated aliphatic, cycloaliphatic or aromatic hydrocarbon radical containing 1 to 30 carbon atoms. Preferably, radicals R, which may be identical or different, are alkyl or alkenyl radicals carrying one or more linear or branched ethylenically unsaturated bonds, containing 8 to 26 carbon atoms. Examples of such radicals that can in particular be cited are the steryl, oleyl, linoleyl and linolenyl radicals. Further, radicals R, which may or may not be identical, can be aromatic radicals carrying alkyl, arylalkyl or alkylaryl substitutes; these radicals contain 6 to 30 carbon atoms: Examples of such radicals that can be cited include nonylphenyl, mono-, di- and tri-styrylphenyl radicals.

More particularly, group OA corresponds to an oxyethlene, oxypropylene or oxybutylene radical or mixtures thereof, Preferably, said group corresponds to an oxyethylene and/or oxypropylene radical.

Reguarding the value of y, a mean value, it is preferably in the rage 0 to 80.

As indicated above, the acid forming part of the composition of the organic phases of the lamellar crystallites is optionally in the neutralised form neutralised with a mineral or organic base.

Suitable bases that can be used to neutralise the acid include basic compounds creating monovalent species.

It should be noted that the bases used are preferably water-soluble.

Non limiting examples of such compounds that can be cited are alkali metal hydroxides, hydroxycarbonates, carbonates and bicarbonates, and ammoniacal solutions.

Suitable organic bases that can be mentioned indude primary, secondary or tertiary amines containug 1 to 40 carbon atoms, optionally substituted with one or more hydroxyl radicals and/or one or more oxyalkylene groups. Said alkylene groups are preferably oxyethylene motifs. Further, the number of oxyalkylene motifs if present is 100 or less.

Suitable amines that can be cited are monoethanolamine, diethanolamine, ethylenediamine, aminoethylethanolamine and aminomethylpropanolamino. Polyoxyalkylenated fatty amines can also be used as the organic base, such as those sold by Rhodia Chimie under the trade name Rhodameene® CS20.

The lamellar cryutaliites also comprise at least one metal in the form of a mutivalent ion. More particularly, said metal can be in the form of a divalent ion or a trivalent ion. A plurality of metals can also be used, with oxidation numbers that may or may not be identical.

In a particular implementation of the invention, said metal is selected from those in columns IIA, VIII, IB, IIB, with the exception of cobalt and nickel.

More particularly, the metals are selected from calcium, magnesium, copper, zinc, iron and aluminum.

It should be noted, and this represents an advantageous implementation of the invention, that the lamellar crystallites can indude a mixture of at least two metals. In a preferred variation, the lamellar crystallites comprise a mixture of two metals, preferably zinc and copper.

In a second implementation of the present invention, the organic phases of the lamellar crystallites comprise at least one polyoxyalkylenated block polymer exhibiting a cloud point.

It should be remembered that the cloud point indicates the temperature of the critical point in the phase diagram of the polymer phases with water, corresponding to the appearance of an attraction between micelles, giving rise to co-existence of a self-organised lamellar phase and a solution.

In an advantageous implementation of the present invention, the polyoxyalkylenated block polymer forming part of the composition of the organic phases ii) exhibits a cloud point in the range 30° C. to 90° C.

Further, the block polymers preferably have a mass average molecular weight between 500 and 50000 g/mole (measured by GPC, standard: polyethylene glycol).

Suitable polymers for use in the present invention comprise oxyetylenated and oxypropylenated and/or oxybutylenated units.

More particularly, the proportion of oxyethylenated/(oxypropylenated and/or oxybutylenated) units in such block polymers is in the range 1.5 to 5.

In a preferred implementation of the invention, the block polymers comprise oxyethylenated and oxypropylenated units.

In the case of lamellar crystallites comprising organinc phases of type ii), it should be noted that the latter are employed by locally increasing the temperature of the medium in which said lamellar crystallites dispersed, to a temperature that is greater than or equal to the cloud point of said block polymer. Such a local increase can a advatageously take place close to the metal surface to be treated/deformed During reactor of deformation, the metal surface generally heats up.

The quantity of lamellar crystallites dispersed in the aqueous lubricant during its use normally represent 0.1% to 5% by weight with respect to the total weight of lubricant during its use. Preferrably, the quanity of lamellar crystallites is in the range 0.1% to 1% by weight with respect to the same reference.

The lamellar crystallites of the invention can be used in the presence of at least one non-ionic surfactant.

Non-limiting examples of non-ionic surfactants that can be cited include:

polyoxyalkylenated alkylphenols wherein the alkyl substitutent is $C_6$–$C_{12}$;

polyoxyalkylenated mono-, di- or tri-(alkylaryl)phenols wherein the alkyl substituent is $C_1$–$C_6$;

polyoxyalkylenated $C_8$–$C_{22}$ aliphatic alcohols;

polyoxyalkylenated triglycerides;

polyoxyalkylenated fatty acids;

polyoxyalkylenated sorbitan esters;

$C_8$–$C_{20}$ fatty acid amides, which may be polyoxyalkylenated.

The number of polyoxyalkylenated motifs, if present, of these non-ionic surfactants is normally 2 to 100. It should be noted that the term "polyoxyalkylenated motifs" designates oxyetylenated, oxypropylenated or mixtures thereof.

The amount of surfactant is normally in the range 0.5% to 5% with respect to the total weight of lubricant during its use.

The process for the preparing the lamellar crystallites of the invention will now be described.

In a first implementation, the lamellar crystallites with type i) organic phases can be produced by bringing a solution or a dispersion comprising the acid, opationally neutralised, into contact with the metal the ionic and/or metallic form.

It should be noted that the term "dispersion" means a dispersion of vesicls, droplets or miscelles in an aqueous medium.

When a dispersion is used, it may be advantageous to use a dispersion comprising at least one non ionic surfactant such as one selected from the above list.

The amount of surfactant, when present, is normally between 1% and 30% of the total weight of concentrated dispersion.

Regarding the metal, this latter can equally be found in its metallic form or in the form of a multivalent cation. Said cation can itself be in the form of a solid, a solution or a dispersion.

When the metal is used in the form of a solution, preferrably an aqueous solution, mineral acid salts can be used, for example, such as halides, for example chlorides; or nitrates; also organic acid salts such as formates or acetates.

It is also possible to envisage using the metal in the form of the oxide, hydroxide. cabonate, or of the metal itself.

Preferrably, contact is accomplished in the presence of at least one compound to buffer the pH. More particularly, one or more compounds are selected so that the pH of the medium is between 7 and 9, preferably between 8 and 8.5.

Contact is carried out with stirring. Preferably, the metal is introduced in the selected form into the solution or dispersion of the acid, optionally neutralised with the mineral or organic base cited above.

The operation is advantageously carried out at a temperature of less than 100° C., preferably at a temperature in the rage 20° C. to 60° C.

In a second implementation, the lamellar crystallites with type ii) organic phase can be obtained by preparing; an aqueous mixture comprising the polymer then locally increasing the temperature of said mixture to a value that is at least equal to or more than that of the cloud point of said polymer.

It should be pointed out that this increase in temperature may simply result from heating due to deformation or friction of the metal and the tool in the metal transformation process, and passage of the polymer beyond its cloud point close to the hot surfaces produces the lamellar crystallites of the invention.

The lamellar crystallites of the invention are thus used, and this constitutes a further aspect of the invention, as an extreme pressure additive in aqueous lubricants used for metal deformation and transformation. The term "deformation" the operations of drawing and rolling. More particularly, the term "transformation operations" designates cutting metals.

The metals that can be subjected to such treatments are in particular and principally steels, stainless steels, aluminum, copper, zinc, tin, copper-based alloys (bronze, brass), etc.

In one preferred implementation of the invention aqueous lubricants comprising the lamellar phase of the invention are employed in drawing brass-coated steel wires.

The aqueous lubricants are generally colloidal dispersions in water. It should be noted that the dispersions can be emulsions, or dispersions of solid particles or organised phases in an aqueous medium.

In general, the pH of the aqueous lubricants is in the range 7 to 9.

They also comprise additives that are convectional in this field such as preservatives, anti-corrosion agents, anti-foaming agents or stabilising agents.

The lamellar crystallites of the invention can be equally be introduced into a tank for treating or deforming new or scrap metal.

It should be noted that the lamellar crystallites of the invention can be introduced into the tank in the form of precursors. In the case of lamellar crystallites costituted by type i) organic phases it is possible to add to the tank an acid solution that is optically neutralised, and also the metal in the required form. In the case of lamellar crystallites comprising type ii) organic Phases, it is possible to add to the tank the block polymer exhibiting a cloud point, which will be tansformed into lamellar crystallites as soon as the local temperature reaches a value that is at least equal to that of the cloud point of said polymer.

A nonlimiting example of the invention will now be given.

EXAMPLE

The following mixture was preferred, in water, with stirring:

Oleic acid: 9% by weight

Ethylene diamine: 5% by weight

Rhodafac PA3.5 (*): 5% by weight $H_3PO_4$/diethanolamine: sufficent quantity to produce pH in the range 8 to 8.5 (buffer)

The resulting mixture was then diluted 10-fold.

Powdered brass (15 g/l) was then added with stirring at 40° C.

The mixture was stirred for 5 days at the temeperature indicated above.

Transmission electron microscopic analysis confirmed that the mixture contained lamellar cryutaliites.

The Figure shows lamellar crystallites with a cross section in the range 50 nm to 100 nm and with a length of more than 2–3 μm (scale of figure: 2 μm).

What is claimed is:

1. A method for deforming or transforming metal by contact with a tool, the method comprising reducing friction between the metal and the tool by introducing an aqueous lubricant comprising lamellar crystallites with a length (L) in the range 0.1 μm to 100 μm, a width (1) in the range 0.5 μm to 30 μm and with a thickness (e) in the range 5 nm to 200 nm, comprising a stack of organic phases (O) and aqueous solutions (A) in the order $O/[A/O]_n$, n being a whole number other than 0, and such that the thickness of the stack is 5 nm to 200 nm, the organic phases comprising:

saturated or unsaturated carboxylic acids containing at least 5 carbon atoms;

acid phosphate esters with formula $(RO)_x—P(=O)(OH)_{x'}$, in which formula R is a hydrocarbon radical, optionally polyalkoxy, x and x' being equal to 1 or 2, provided that the sum of x and x' is 3;

said acid optionally being neutralised by an organic or mineral base; and at least one metal in the form of a multivalent ion.

2. The method according to claim 1, wherein the length of the lamellar crystallites is in the range of 0.5 μm to 20 μm.

3. The method according to claim 1, wherein the width of the lamellar crystallites is in the range of 0.5 μm to 10 μm.

4. The method according to claim 1, wherein the thickness of the lamellar crystallites is in the range of 10 nm to 100 nm.

5. The method according to claim 1, wherein the acid of the organic phase is at least one saturated or unsaturated mono- or poly-carboxylic acid containing 5 to 40 carbon atoms.

6. The method according to claim 1, wherein the acid of the organic phase is at least one acid having the following formula:

$$R^1—COOH;$$

in which formula $R^1$ represents a linear or branched alkyl radical or an alkenyl radical containing one or more ethylenically unsaturated bonds, containing 5 to 40 carbon atoms (including the carbon atom of the carboxyl group), optionally substituted with one or more hydroxyl radicals and/or at least one carboxylic function.

7. The method according claim 1, wherein the acid of the organic phase is at least one acid phosphate ester having the following formula:

$$(R(OA)_y)_x—P(=O)(OH)_{x'}$$

in which R represents a hydrocarbon radical containing 1 to 30 carbon atoms, A is a linear or branched alkylene radical containing 2 to 4 carbon atoms, y, which is a mean value, is in the range of 0 to 100, and x and x' are equal to 1 or 2, provided that the sum of x and x' is 3.

8. The method according to claim 1, wherein the acid of organic phase is neutralised using a base selected from basic compounds creating monovalent species.

9. The method according to claim 1, wherein the mineral base is selected from the group consisting of alkali metal hydroxides, hydroxycarbonates, carbonates and bicarbonates, and ammoniacal solutions.

10. The method according to claim 8, wherein the organic base is selected from primary, secondary and tertiary amines containing 1 to 40 carbon atoms, optionally substituted with one or more hydroxyl radicals, and/or optionally by one or more oxyalkylenated groups.

11. The method according to claim 1, wherein the organic phase comprises at least one metal in the form of a multivalent cation selected from columns IIA, VIII, IB, IIB, with the exception of cobalt and nickel.

12. The method according to claim 1, wherein the aqueous lubricants comprise at least one non-ionic surfactant.

13. The method according to claim 1, wherein the metal being deformed or transformed comprises steels, stainless steels, aluminum, copper, zinc, tin, or copper-based alloys (bronze, brass).

14. The method according to claim 1, wherein the step of deforming or transforming comprises drawing brass-coated steel wires.

15. The method according to claim 1, wherein the crystallites comprise an extreme pressure compound.

16. Lamellar crystallites with a length (L) in the range 0.1 μm to 100 μm, a width (1) in the range 0.5 μm to 30 μm and with a thickness (e) in the range 5 nm to 200 nm, comprising a stack of organic phases (O) and aqueous solutions (A) in the order $O/[A/O]_n$, n being a whole number other than 0 and such that the thickness of the stack is 5 nm to 200 nm, the organic phases comprising:

saturated or unsaturated carboxylic acids containing at least 5 carbon atoms;

acid phosphate esters with formula $(RO)_x—P(=O)(OH)_{x'}$, in which formula R is a hydrocarbon radical, optionally polyalkoxy, x and x' being equal to 1 or 2, provided that the sum of x and x' is 3;

said acid optionally being neutralised by an organic or mineral base; and at least one metal in the form of a multivalent ion.

17. Lamellar crystallites according to claim 16, wherein said lamellar crystallites are dispersed in an aqueous medium comprising at least one non-ionic surfactant.

18. Lamellar crystallites according to claim 16, wherein their length is in the range of 0.5 μm to 20 μm.

19. Lamellar crystallites according to claim 16, wherein the width of the lamellar crystallites is in the range of 0.5 μm to 10 μm.

20. Lamellar crystallites according to claim 16, wherein the thickness of the lamellar crystallites is in the range of 10 nm to 100 nm.

21. Lamellar crystallites according to claim 16, wherein the acid of the organic phase is at least one saturated or unsaturated mono- or poly-carboxylic acid containing 5 to 40 carbon atoms.

22. Lamellar crystallites according to claim 16, wherein the acid of organic phase is at least one acid with the following formula:

$R^1$—COOH;

in which formula $R^1$ represents a linear or branched alkyl radical or an alkenyl radical comprising one or more ethylenically unsaturated bonds, containing 5 to 40 carbon atoms (including the carbon atom of the carboxyl group), optionally substituted with one or more hydroxyl radicals and/or at least one carboxylic function.

23. Lamellar crystallites according to claim 16, wherein the acid of organic phase is at least one acid phosphate ester with the following formula:

$$(R(OA)_y]_x—P(=O)(OH)_{x'},$$

in which R is a hydrocarbon radical containing 1 to 30 carbon atoms, A is a linear or branched alkylene radical containing 2 to 4 carbon atoms, y, which is a mean value, is in the range 0 to 100, x and x' being equal to 1 or 2, provided that the sum of x and x' is 3.

24. Lamellar crystallites according to claim 16, wherein the acid of organic phase is neutralised using a base selected from basic compounds creating monovalent species.

25. Lamellar crystallites according to claim 16, wherein the organic phase comprises at least one metal in the form of a multivalent cation selected from columns IIA, VIII, IB, IIB, with the exception of cobalt and nickel.

26. A process for preparing lamellar crystallites according to claim 16, comprising contacting a solution or dispersion comprising the acid that is optionally neutralised with the metal in the ionic and/or metallic form.

27. A process according to claim 26, wherein a dispersion comprising at least one non-ionic surfactant is used.

* * * * *